US010251453B2

(12) United States Patent
Ritchie

(10) Patent No.: US 10,251,453 B2
(45) Date of Patent: Apr. 9, 2019

(54) BUCKLE

(71) Applicant: MRM HK Limited, Western District (HK)

(72) Inventor: Luke Ritchie, Yuen Long (HK)

(73) Assignee: MRM HK Limited, Hong Kong (HK)

( * ) Notice: Subject to any disclaimer, the term of this patent is extended or adjusted under 35 U.S.C. 154(b) by 0 days.

(21) Appl. No.: 15/478,409

(22) Filed: Apr. 4, 2017

(65) Prior Publication Data

US 2017/0280831 A1 Oct. 5, 2017

(30) Foreign Application Priority Data

Apr. 5, 2016 (AU) ..... 2016901262

(51) Int. Cl.
*A44B 11/25* (2006.01)
*E05B 67/38* (2006.01)
*E05B 73/00* (2006.01)

(52) U.S. Cl.
CPC ..... *A44B 11/2596* (2013.01); *E05B 67/383* (2013.01); *E05B 73/0005* (2013.01)

(58) Field of Classification Search
CPC ..... A44B 11/2596
See application file for complete search history.

(56) References Cited

U.S. PATENT DOCUMENTS

| | | | | |
|---|---|---|---|---|
| 2,956,324 | A | 10/1960 | Klein | |
| 5,671,516 | A | 9/1997 | Sartori | |
| 8,857,019 | B1 | 10/2014 | Nykoluk | |
| 2007/0186394 | A1 | 8/2007 | Hsiao | |
| 2007/0220719 | A1 | 9/2007 | Shen | |
| 2009/0094811 | A1 | 4/2009 | Young | |
| 2013/0011179 | A1 | 1/2013 | Fiedler | |
| 2014/0341639 | A1* | 11/2014 | Iannello | A44C 5/2066 403/119 |

* cited by examiner

*Primary Examiner* — Robert Sandy
(74) *Attorney, Agent, or Firm* — Faegre Baker Daniels LLP

(57) ABSTRACT

A buckle includes a male coupler including a bar portion with an external surface, a first flange protruding from the external surface, the first flange being adapted for connection of a strap thereto; a female coupler with a hollow body having an opening therein, the opening including an end part at a first axial end of the hollow body and a slot part extending generally axially from the end part of the opening, the slot part having opposing lips extending along the slot, the hollow body having an internal surface complementary to the external surface of the bar portion; a detent for releasably holding the bar portion in the hollow body; and wherein the lips extend reentrantly and each lip is adjacent a respective inwardly-extending face in the bar portion.

17 Claims, 3 Drawing Sheets

BUCKLE

CROSS-REFERENCE TO RELATED APPLICATIONS

This application claims the benefit of Australian Patent Application No. 2016901262, filed Apr. 5, 2016.

TECHNICAL FIELD

The present invention relates to a buckle, as for connecting flexible articles such as straps.

BACKGROUND OF THE INVENTION

A buckle is commonly used in a bag for releasably connecting straps to the bag. The buckle generally includes male and female couplers each arranged to connect with a strap piece, such that when coupled they form a handle or shoulder strap assembly.

To provide some degree of security when leaving a bag briefly unattended the user may loop a releasably fastened shoulder strap about a piece of furniture, or the like. This simple technique can be performed quickly and without drawing attention and this has been found sufficient to defeat casual theft.

Some prior art solutions, such as U.S. Pat. No. 2,956,324 and U.S. Pat. No. 5,671,516, have provided buckles with a coupling axis oblique to a lengthwise direction of the strap. These buckles rely on the tension of the belt to urge the male and female couplers together to maintain a closed position. These old buckles are vulnerable to accidental release if the tension in the belt is released or if the belt is twisted, making them unsuitable to prevent casual theft, as the release of tension on the belt or twisting of the belt cannot be avoided. It will be understood, therefore, that there is a need for a buckle for such an application that is able to provide improved deterrence of casual theft, without substantially increasing the cost of the buckle. It is an object of the present invention to overcome to address this need or, more generally, to provide an improved buckle.

SUMMARY

According to one aspect of the present invention there is provided a buckle comprising:

a male coupler including a bar portion with an external surface, a first flange protruding from the external surface, the flange being adapted for connection of a strap thereto;

a female coupler with a hollow body having an opening therein, the opening including an end part at a first axial end of the hollow body and a slot part extending generally axially from the end part of the opening, the slot part having opposing lips extending along the slot, the hollow body having an internal surface complementary to the external surface of the bar portion, such that the bar portion can be entered through the end part of the opening as the flange slides through the slot part of the opening;

a detent for releasably holding the bar portion in the hollow body; and wherein the lips extend reentrantly and each lip is adjacent a respective inwardly-extending face in the bar portion.

The lips and inwardly-extending faces cooperate to increase the strength of the buckle as, when a tensile load tends to pull the couplers apart, the lips abut the inwardly-extending faces and are thereby restrain opening of the slot part that would tend to release the bar portion from the hollow body.

In some embodiments, the inwardly-extending face is formed in a trough recessed in the external surface.

In some embodiments, the slot part diverges width-wise toward the first axial end, providing a taper that assists in guiding the first flange into the slot part.

In some embodiments, the taper comprises a convex edge. Preferably the taper further comprises a concave edge.

In some embodiments, internal transverse dimensions of the hollow body are substantially constant throughout its length. No tapering in the transverse direction, for instance near the end part, is necessary to assists in guiding the first flange into the slot part owing to the taper provided by the diverging slot.

In some embodiments, the slot part extends for the full axial dimension of the hollow body.

In some embodiments, an internal web is provided in the hollow body, at a second end axially opposite the first axial end of the hollow body to prevent the bar portion passing out of the second end.

In some embodiments, the first flange comprises a strap-receiving slot substantially parallel to the bar portion for receiving the strap.

In some embodiments, a rib on the external surface adjacent the trough is received between opposing edges of the slot part, such that an elongate edge of the slot is bounded by an outer face of the rib.

In some embodiments, the rib diverges width-wise toward the end part in a manner complementary to the slot part.

In some embodiments, a second flange protrudes from a side of the hollow body opposite the slot part, the second flange comprising a strap-receiving slot substantially parallel to the hollow body.

In some embodiments, a detent is provided in the bar portion, the detent including a latch biased to extend from the external surface into a recess in the hollow body and an actuator that protrudes axially from a first end of the bar portion and is moveable axially to retract the latch inside the external surface.

In some embodiments, the bar portion comprises an axial channel and the actuator comprises a protrusion sized to be slidingly received in the axial channel when the actuator is moved axially to retract the latch, and the actuator is rotatable about a longitudinal axis between a first angular position in which the protrusion is axially aligned with the axial channel and a second angular position in which the protrusion is axially aligned with a stop surface of the bar portion, whereby in the second angular position axial movement of the actuator pushes the protrusion to abut the stop surface thereby preventing axial movement sufficient to retract the latch.

In some embodiments, the hollow body is penannular and the recess extends through the hollow body.

In some embodiments, indicia are provided on the female coupler to align with the protrusion in the first and second angular positions and thereby indicate unlocked and locked status respectively.

In some embodiments, an eye is formed on the bar portion, at a second end axially opposite the first end, providing an opening for receiving a shackle of a padlock.

In some embodiments, a transverse recess is provided in the hollow body, at a second end axially opposite the first axial end of the hollow body and located for registration with the opening in the eye so as to receive the shackle of the padlock.

According to another aspect of the present invention there is provided a buckle comprising:

a male coupler including a bar portion with an external surface, a first flange protruding from the external surface, the first flange being adapted for connection of a strap thereto;

a female coupler with a hollow body having an opening therein, the opening including an end part at a first axial end of the hollow body and a slot part extending generally axially from the end part of the opening, the slot part having opposing lips extending along the slot, the hollow body having an internal surface complementary to the external surface of the bar portion, such that the bar portion can be entered through the end part of the opening as the first flange slides through the slot part of the opening;

a detent for releasably holding the bar portion in the hollow body; and wherein the detent is provided in the bar portion, the detent including a latch biased to extend from the external surface into a recess in the hollow body and an actuator that protrudes axially from a first end of the bar portion and is moveable axially to retract the latch inside the external surface.

In some embodiments, the hollow body is penannular and the recess extends through the hollow body.

In some embodiments, the buckle further comprises indicia provided on the female coupler to align with the protrusion in the first and second angular positions and thereby indicate unlocked and locked status respectively.

In some embodiments, the buckle further comprise an eye formed on the bar portion, at a second end axially opposite the first end, providing an opening for receiving a shackle of a padlock.

In some embodiments, the buckle further comprises a transverse recess provided in the hollow body, at a second end axially opposite the first axial end of the hollow body and located for registration with the opening in the eye so as to receive the shackle of the padlock.

In some embodiments, the buckle is fixed to a security baggage.

In some embodiments, the male and female couplers are connected to respective straps by respective permanent loops in the straps, at least one of the straps being permanently fixed to the baggage.

This invention provides a releasably lockable buckle with lips and inwardly-extending faces, a latch lock mechanism, for resisting tensile load in all directions in a locked state. The buckle of the invention is strong, safe, and secure.

BRIEF DESCRIPTION OF THE DRAWINGS

Preferred forms of the present invention will now be described by way of example with reference to the accompanying drawings, wherein.

DETAILED DESCRIPTION

Figure 1:
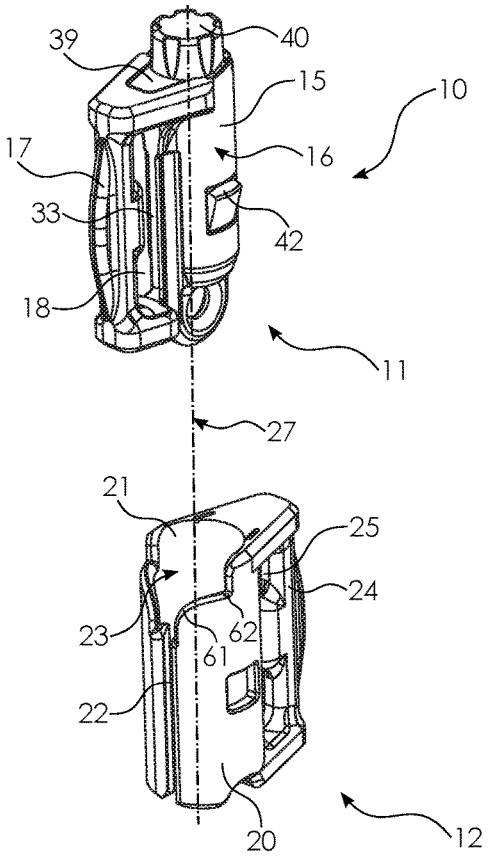
FIGS. 1 and 2 are perspective views of the male and female couplers of the buckle of the invention separated and connected respectively.
Figure 2:
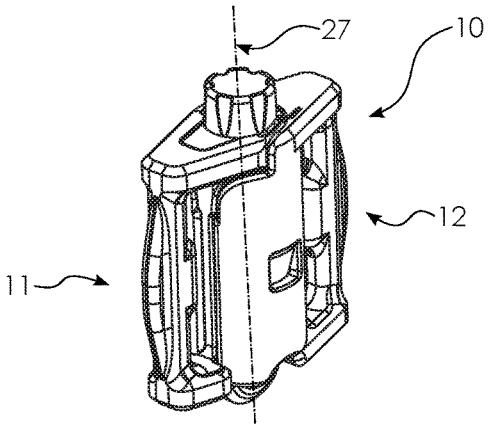

Referring to FIGS. 1 and 2, a buckle 10 generally comprises a female coupler 12 for receiving a male coupler 11. Straps 13, 14 may be fixed to the male coupler 11 and female coupler 12 respectively, as for connecting a shoulder strap to a bag.

The male coupler 11 includes a bar portion 15 with an external surface 16 which may be generally cylindrical. A first flange 17 protrudes from the external surface 16 of the bar portion 15. A strap-receiving slot 18 in the first flange 17 may be elongated parallel to the bar portion 15 for receiving a loop 19 formed in the end of the strap 13 to fix the end of the end of the strap thereto. The strap-receiving slot 18 in the first flange 17 may bound and define a rib 33 that protrudes from the bar portion 15 into the strap-receiving slot 18.

As used herein, the term "axial" refers to a direction substantially parallel to the coupling axis 27, which is transverse to the straps 13, 14. The term "radial" refers to a direction substantially orthogonal to the coupling axis 27. The term "circumferential" refers to the direction of a circular arc having a radius substantially orthogonal to the coupling axis 27.

The female coupler 12 includes an elongate hollow body 20 having an opening therein, the opening including an end part 21 at a first axial end of the hollow body 20 and a slot part 22 extending generally axially from the end part 21, such that the end part 21 and slot part 22 together form a single opening 21, 22. The hollow body 20 may thus be penannular with an internal surface 23 that is cylindrical, so as to be complementary to the external surface 16, such that the bar portion 15 can be entered through the end part 21 as the flange 17 slides through the slot part 22. A second flange 24 protrudes from a side of the hollow body 20 opposite the slot part 22, and may comprise a strap-receiving slot 25 substantially parallel to the elongate hollow body 20 for receiving a loop 26 formed in the end of the strap 14 to fix the end of the end of the strap thereto. The length of the second flange 24 in the axial direction may be substantially the same as that of the hollow body 20.

Figure 3:
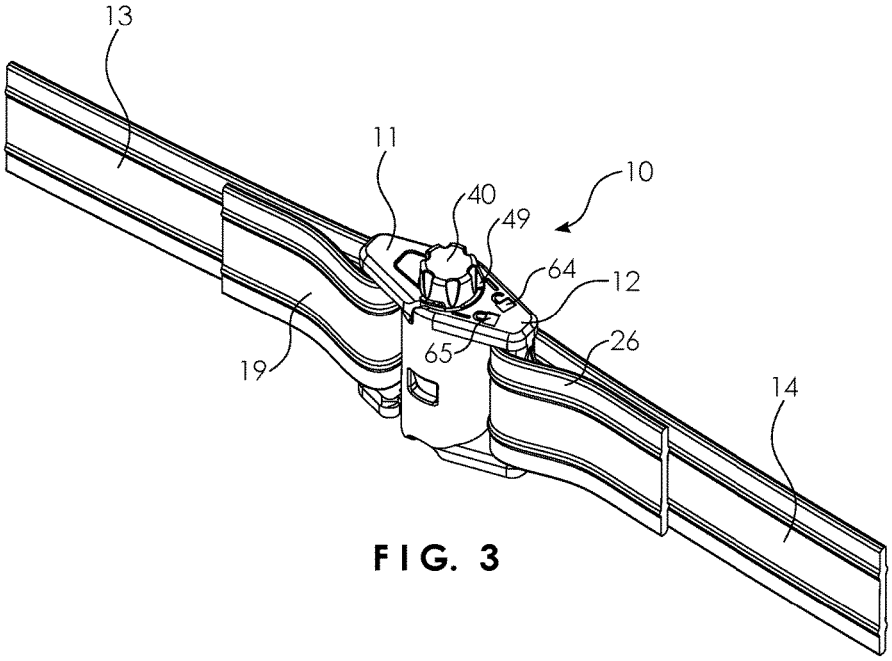
FIG. 3 is a perspective view of the connected couplers of FIG. 2 in use, further connected to straps.

FIG. 3 illustrates an exemplary mounting of the buckle 10 on security baggage (not shown) where the loops 19, 26 are permanent loops, formed by turning the end of the straps 13, 14 back onto themselves and fixing them together, as by stitching, adhesive etc. One of the straps 13, 14 may be an elongate shoulder strap, while the other may be a shorter length permanently fixed to the baggage, as by stitching.

Figure 5:
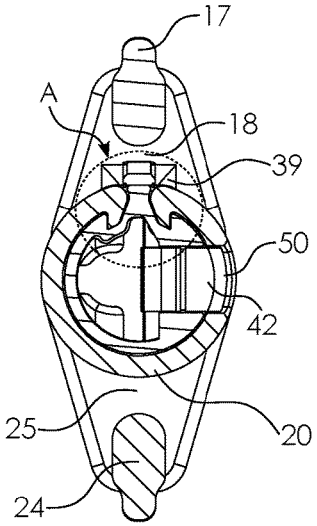
Figure 6:
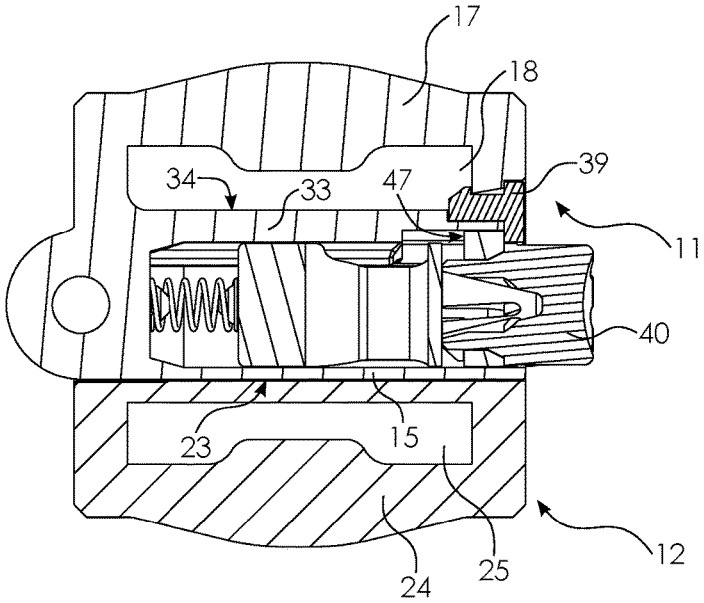
FIG. 6 is a section in a plane orthogonal to the axis of the connected couplers of FIG. 2.
Figure 7:
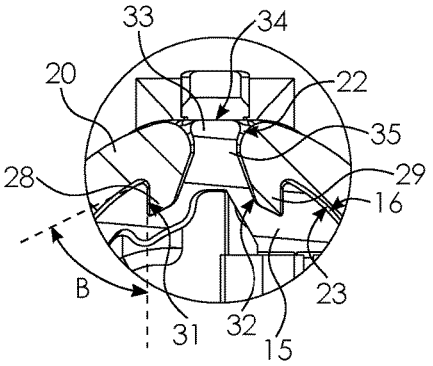
FIG. 7 is an enlargement of Detail A of FIG. 5.

Referring to FIGS. 5 and 7, opposing longitudinal edges of the slot part 22 terminate in lips 28, 29 that extend reentrantly. Each lip 28, 29 is adjacent a respective inwardly-extending face 31 in the bar portion. The lips 28, 29 may be of like form, arranged with reflective symmetry either side of an axially extending plane (not shown) bisecting the slot part 22. Owing to the re-entrant form of the lips 28, 29 they cooperate with the inwardly-extending faces 31 to increase the strength of the buckle 10 as, when a tensile load tends to pull the couplers 11, 12 apart, the lips 28, 29 abut the inwardly-extending faces 31 and are thereby restrain opening of the slot part 22 that would tend to release the bar portion 15 from the hollow body 20.

Each inwardly-extending face 31 extends inwardly of the inner surface 23 and may be acutely inclined to the intersecting part of the inner surface 23, as at an angle B of 45° to 65° between inwardly-extending face 31 and a line tangential to the inner surface 23. The inwardly-extending face 31 may be formed in a trough 32 recessed in the external surface 16. The rib 33 of the flange 17 may be formed on bar portion 15 adjacent to and between the two troughs 32. The rib 33 may be generally of complementary form to the slot part 22, with a waist portion 35 in the narrowest portion of the slot part 22 and received between opposing edges of the slot part 22, such that the mouth of the slot part 22 is closed by an outer face 34 of the rib 33.

Figure 8:
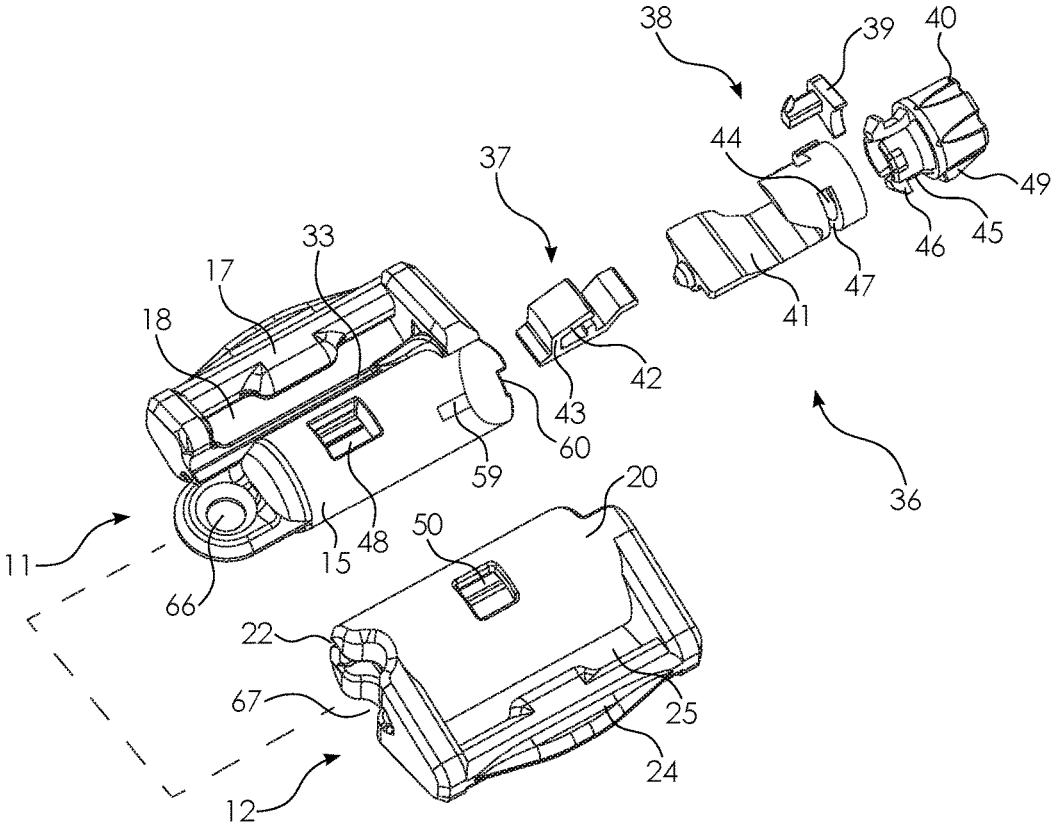
FIG. 8 is an exploded perspective view of the male and female couplers of the invention.

FIG. 8 illustrates, in exploded form, the components of a detent 36 for releasably holding the bar portion 15 in the hollow body 20. The detent 36 includes a bracket 37 and an actuator assembly 38 including an actuator 40, a frame 41, a fastener 39 and a spring 52. The bracket 37 includes a cantilever-type member that provides an integral latch 42, resiliently connected along one edge to the bracket by a living hinge 43.

At an axially outer end the frame 41 includes a circular opening 44 bounded by a shoulder. Resilient tongues protruding from the actuator 40 each have part-cylindrical surfaces 45 that are received in the opening 44, supporting the actuator 40 for rotation, while tips 46 of the tongues engage the shoulder 47 with a snap fit to locate the actuator 40 axially. Protruding from the generally frusto-conical outer surface of the actuator 40 is a protrusion 49.

The components of the detent 36 are received in an axially extending blind opening in the bar portion 15 and held in place by the fastener 39. At an intermediate position along the bar portion 15 is an opening 48 from which the latch 42 may project and which is located for registration with a recess 50 extending through the wall of the hollow body 20. The latch 42 has an inclined outer face 58 inclined at an acute angle to the axis 27 and which projects into the recess 50, with its distal edge outermost and opposing proximal edge innermost and located in the opening 48, such that axial movement of the latch 42 causes the edge of the recess 50 to abut the inclined outer face 58 to rotate the latch 42 about the living hinge 43 and retract the distal edge inside the external surface 16. The latch 42 snaps into the recess 50 with a "click" to provide audible confirmation that the detent is holding the male and female couplers 11, 12. Opposing ends of a compression spring 52 abut the frame 41 and the inner end of the blind opening, to bias the actuator 40 outwardly and the latch into a position in which it protrudes into the recess 50.

The bar portion 15 may comprise an axial channel 59 that slidingly receives the protrusion 49 when the actuator 40 is moved axially inwardly to retract the latch 42. The actuator 40 is rotatable about axis 27 between a first angular position in which the protrusion 49 is axially aligned with an axial channel 59 (shown in dashed outline in FIG. 8) and a second angular position in which the protrusion 49 is axially aligned with a stop surface 60 of the bar portion, whereby in the second angular position axial movement of the actuator 40 pushes the protrusion 49 to abut the stop surface 60 thereby preventing axial movement sufficient to retract the latch 42. Indicia 64, 65 are provided on the female coupler 12 (see FIG. 3) to align with the protrusion 49 in the first and second angular positions and thereby indicate unlocked and locked status respectively.

As best seen in FIG. 1, the slot part 22 diverges widthwise toward the first axial end where it intersects the end part 21, providing a taper that assists in guiding the first flange 17, in particular the rib 33 of the first flange 17, into the slot part 22. This taper may comprise both a convex edge 61 and a concave edge 62. Opposite sides of the rib 33 lie adjacent the edges of the slot part 22 and the rib 33 diverges widthwise toward the end part in a manner complementary to the divergence of the slot part 22.

The internal diameter of the hollow body 20 is substantially constant throughout its length. No tapering in the transverse direction, for instance to produce a frusto-conical mouth, is necessary to assist in guiding the first flange 17 into the slot part, owing to the taper provided by the diverging slot part 22.

Figure 4:
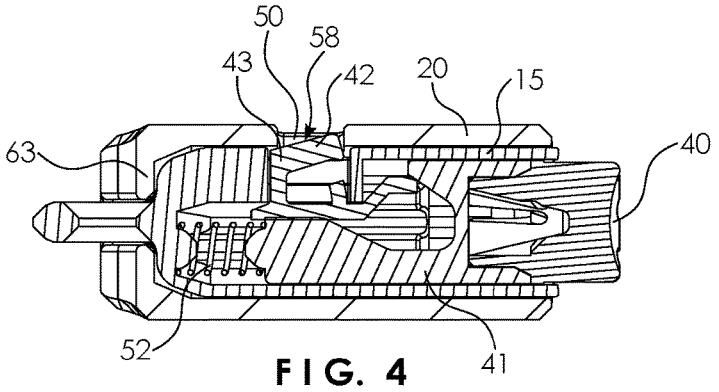
FIGS. 4 and 5 are sections in orthogonal planes in which lies an axis of the connected couplers of FIG. 2.

FIG. 4 also shows that an internal web 63 is provided in the hollow body 20, at a second end axially opposite the first axial end to prevent the bar portion 15 passing out of the second end since, as best seen in FIG. 1, the slot part 22 extends for the full axial dimension of the hollow body 20. The symmetry of this arrangement means that under a tensile load acting to separate the male coupler 11 and female coupler 12 the loads applied at the interface between the bar portion 15 and the hollow body 20 are more evenly distributed.

In addition, for added security, the male coupler 11 and female coupler 12 may be locked together with a padlock. For this purpose, an eye 66 is formed on the bar portion (best seen in FIG. 8), at the second end axially opposite the first end, providing an opening for receiving a shackle of the padlock. A transverse recess 67 is provided in the hollow body 20, at a second end axially opposite the first axial end of the hollow body and located for registration with the eye 66 so as to receive the shackle of the padlock.

The invention thus provides a buckle with three levels of security. At the basic level the detent 36 provides automatic latching when the two buckle parts are connected and, as the actuator 40 must be depressed to release the detent, unwanted or accidental release is mitigated. The intermediate level of security is provided if the user turns the actuator 40 about its axis to align the protrusion 49 with the locked indicator 65 and prevent depression of the actuator 40. Providing a single actuator 40 perform these two functions is not only ergonomically advantageous, but it reduces the part count and results in a neat, compact package. The top level of security requires a padlock to be connected to the buckle, with its shackle through the eye 66, thus allowing the user to employ a level of security appropriate to the circumstances.

Aspects of the present invention have been described by way of example only and it should be appreciated that modifications and additions may be made thereto without departing from the scope thereof.

The invention claimed is:

1. A buckle comprising:

a male coupler including a bar portion with an external surface, a first flange protruding from the external surface, the first flange being adapted for connection of a strap thereto;

a female coupler with a hollow body having an opening therein, the opening including an end part at a first axial end of the hollow body and a slot part extending generally axially from the end part of the opening, the slot part having opposing lips extending along the slot, the hollow body having an internal surface complementary to the external surface of the bar portion, such that the bar portion can be entered through the end part of the opening as the first flange slides through the slot part of the opening; and a detent for releasably holding the bar portion in the hollow body, wherein the lips extend reentrantly and each lip is adjacent a respective inwardly-extending face in the bar portion, and the detent is provided in the bar portion, the detent including a latch biased to extend from the external surface of the bar portion into a recess in the hollow body and an actuator that protrudes axially from a first end of the bar portion and is moveable axially to retract the latch inside the external surface of the bar portion.

2. The buckle of claim 1, wherein the inwardly-extending face is formed in a trough recessed in the external surface of the bar portion.

3. The buckle of claim 2, wherein the first flange comprises a rib projecting from the external surface of the bar portion adjacent the trough, and the rib is received between opposing edges of the slot part such that an elongate edge of the slot is bounded by an outer face of the rib.

4. The buckle of claim 3, wherein the rib diverges width-wise toward the end part in a manner complementary to the slot part.

5. The buckle of claim 1, wherein the slot part diverges width-wise toward the first axial end, providing a taper that assists in guiding the first flange into the slot part.

6. The buckle of claim 5, wherein the taper comprises a convex edge.

7. The buckle of claim 6, wherein the taper further comprises a concave edge.

8. The buckle of claim 1, wherein internal transverse dimensions of the hollow body are substantially constant throughout its length.

9. The buckle of claim 1, wherein the slot part extends for the full axial dimension of the hollow body such that the hollow body is penannular.

10. The buckle of claim 1, further comprising an internal web provided in the hollow body, at a second end axially opposite the first axial end of the hollow body, to prevent the bar portion from passing out of the second end.

11. The buckle of claim 1, wherein the first flange comprises a strap-receiving slot substantially parallel to the bar portion for receiving the strap.

12. The buckle of claim 1, further comprising a second flange that protrudes from a side of the hollow body opposite the slot part, the second flange comprising a strap-receiving slot substantially parallel to the hollow body.

13. The buckle of claim 1, wherein the bar portion comprises an axial channel and the actuator comprises a protrusion sized to be slidingly received in the axial channel when the actuator is moved axially to retract the latch, and the actuator is rotatable about a longitudinal axis between a first angular position in which the protrusion is axially aligned with the axial channel and a second angular position in which the protrusion is axially aligned with a stop surface of the bar portion, whereby in the second angular position axial movement of the actuator pushes the protrusion to abut the stop surface thereby preventing axial movement sufficient to retract the latch.

14. The buckle of claim 13, wherein the hollow body is penannular and the recess extends through the hollow body.

15. The buckle of claim 13, further comprising indicia provided on the female coupler to align with the protrusion in the first and second angular positions and thereby indicate unlocked and locked status respectively.

16. The buckle of claim 1, further comprising an eye formed on the bar portion, at a second end axially opposite the first end, providing an opening for receiving a shackle of a padlock.

17. The buckle of claim 16, further comprising a transverse recess provided in the hollow body at a second end axially opposite the first axial end of the hollow body and located for registration with the opening in the eye so as to receive the shackle of the padlock.

* * * * *